US005499761A

United States Patent [19]

Reimers

[11] Patent Number: 5,499,761

[45] Date of Patent: Mar. 19, 1996

[54] ADJUSTABLE BALANCE GOLF BAG

[76] Inventor: Eric W. Reimers, 1235 Starwood, Missoula, Mont. 59802

[21] Appl. No.: 184,585

[22] Filed: Jan. 21, 1994

[51] Int. Cl.[6] ..... A63B 55/00

[52] U.S. Cl. ..... 224/202; 224/257; 206/315.3

[58] Field of Search ..... 224/202, 205, 224/209, 210, 257–259, 264; 206/315.3, 315.7, 315.8; 150/107, 108

[56] References Cited

U.S. PATENT DOCUMENTS

| | | | |
|---|---|---|---|
| 2,364,223 | 12/1944 | Keim | 206/315.3 |
| 2,422,315 | 6/1947 | Robinson | 206/315.7 |
| 3,016,939 | 1/1962 | Lowy | 150/108 X |
| 4,487,347 | 12/1984 | Zegar | 224/259 |
| 4,676,464 | 1/1987 | Reimers | 206/315.7 X |
| 4,724,989 | 2/1988 | Silberberg | 224/202 |
| 4,796,752 | 1/1989 | Reimers | 206/315.3 |
| 5,042,703 | 8/1991 | Izzo | 224/209 |

*Primary Examiner*—J. Casimer Jacyna

*Attorney, Agent, or Firm*—Michael J. Hughes; Bradley T. Sako

[57] ABSTRACT

An adjustable balance golf bag 10 with a golf bag spine 18, is provided, having an extended post 22 attached parallel to, and offset from, the golf bag spine 18. A carrying strap assembly 24 is attached to the extended post 22 by a first connector assembly 26 and a second connector assembly 28. The first connector assembly 26 slides along a lower portion of the extended post 22 and includes a locking mechanism 96 for locking the first connector assembly 26 in place on the extended post 22. The second connector assembly 28 is situated towards an extended post upper end 52 and is prevented from sliding along the extended post 22 by a second stop ring 134 and a post end stop 136. Both the first and second connector assemblies (26 and 28) freely rotate about the extended post 22.

13 Claims, 4 Drawing Sheets

ADJUSTABLE BALANCE GOLF BAG

TECHNICAL FIELD

This invention relates generally to carrying bags and more particularly to golf bags for organizing and transporting a set of golf clubs.

BACKGROUND ART

While the most notable attraction of the game of golf is the pitting of individual strengths and skills in ultimately sinking the golf ball into the hole, the game possesses a second, and to some golfers, more compelling attraction; the rejuvenating effect of strolling outdoors, across manicured, sometimes beautifully designed courses, accompanied by friends, family, and/or associates.

Unfortunately, the satisfaction of such occasions can be severely curtailed, if not completely marred by a poorly balanced golf bag. The frustration generated by an off-balance and unruly bag can ruin a relaxed mindset, interrupt concentration, and even waste precious recreation time if the bag is so unbalanced as to spill its contents, or repeatedly slip on the shoulder.

Nearly all bags include a strap, usually permanently attached along the spine of the golf bag. Some bags provide an optimal balance point for the carrying strap by the position at which the carry strap is connected to the bag. One such bag is set forth in U.S. Pat. No. 4,796,752, issued to the present inventor on Jan. 10, 1989. While providing an optimal strap connection point, the straps are adjustable by a well-known arrangement of buckles. Such buckle arrangements, however, can be very time consuming to adjust. In addition, such arrangement have limited flexibility due to the permanent attachment of the straps at both ends. The actual positions at which the strap is attached to the bag are not adjustable, providing only limited balance adjustments by shortening or lengthening the straps. Golf is not a sport requiring particular height or body mass, and so golfers' sizes vary enormously, yet the prior art provides only limited balance adjustments for such a wide range of people.

None of the prior art effectively provides a golf bag design that successfully addresses the above mentioned concerns.

SUMMARY OF THE INVENTION

Accordingly, it is an object of the present invention to provide a golf bag design with a strap that is attached to the golf bag body in a slidable manner.

It is a further object of the present invention to provide a golf bag design that provides for rotational adjustment at the points where the strap is connected to the bag.

It is a further object of the present invention to provide a golf bag design that provides for an adjustable strap attachment beyond the main body of the golf bag.

It is yet another object of the present invention to provide a golf bag with an easily and quickly adjustable strap.

It is yet another object of the present invention to provide a golf bag with a quickly adjustable strap.

Briefly, a preferred embodiment of the present invention is a golf bag with a post longitudinally disposed along the spine of the golf bag and extending beyond the top surface thereof, and a strap that is attached to the post by the two connector assemblies.

In the preferred embodiment, the first connector assembly is disposed towards the lower end of the bag, and completely surrounds the extended post. The first connector assembly includes a locking mechanism that, when unlocked, allows the connector assembly and associated strap end to freely slide along the extended post. When the locking mechanism is locked, the first connector is locked into place in its position along the extended post.

A second connector is located toward or beyond the upper end of the bag. Like the first connector, the second connector completely surrounds, and is free to rotate about the extended post. In the preferred embodiment the second connector assembly, unlike the first connector assembly, does not slide along the extended post, and so does not include a locking mechanism as it is held in place by a stop ring, and a semi-spherical post end. The second connector assembly therefore does not require a locking mechanism. The extended post is disposed along the spine of the golf bag so that the unique strap is presented in the same position as a typical golf bag strap. An alternate structure includes an extendible post so that a terminus even farther from the top of the bag may be achieved and more extreme balance positions may be selected.

An advantage of the present invention is that it provides a golf bag with a wider range of balance adjustments than a typical golf bag, making the adjustable balance golf bag usable by a larger number of golfers.

Another advantage of the present invention is that it provides a golf bag that can transport a wider range of club sizes and arrangements due to an extensive range of strap adjustments.

A further advantage of the present invention is that it provides a golf bag with quick strap adjustment capabilities, allowing a golfer to quickly adapt to varying terrain and carrying conditions.

Still another advantage of the invention is that it provides the additional strap adjustment capabilities for a more customized golf bag fit.

These and other objects and advantages of the present invention will become clear to those skilled in the art in view of the description of the best presently known mode of carrying out the invention and the industrial applicability of the preferred embodiment as described herein and as illustrated in the several figures of the drawing.

BEST MODE OF CARRYING OUT THE INVENTION

The preferred embodiment of the present invention is an adjustable balance golf bag design that includes a unique collar and base structure, as well as an extended post and an adjustable carrying strap assembly, all to provide optimum carrying balance for golfers of varying physical characteristics.

Figure 1:
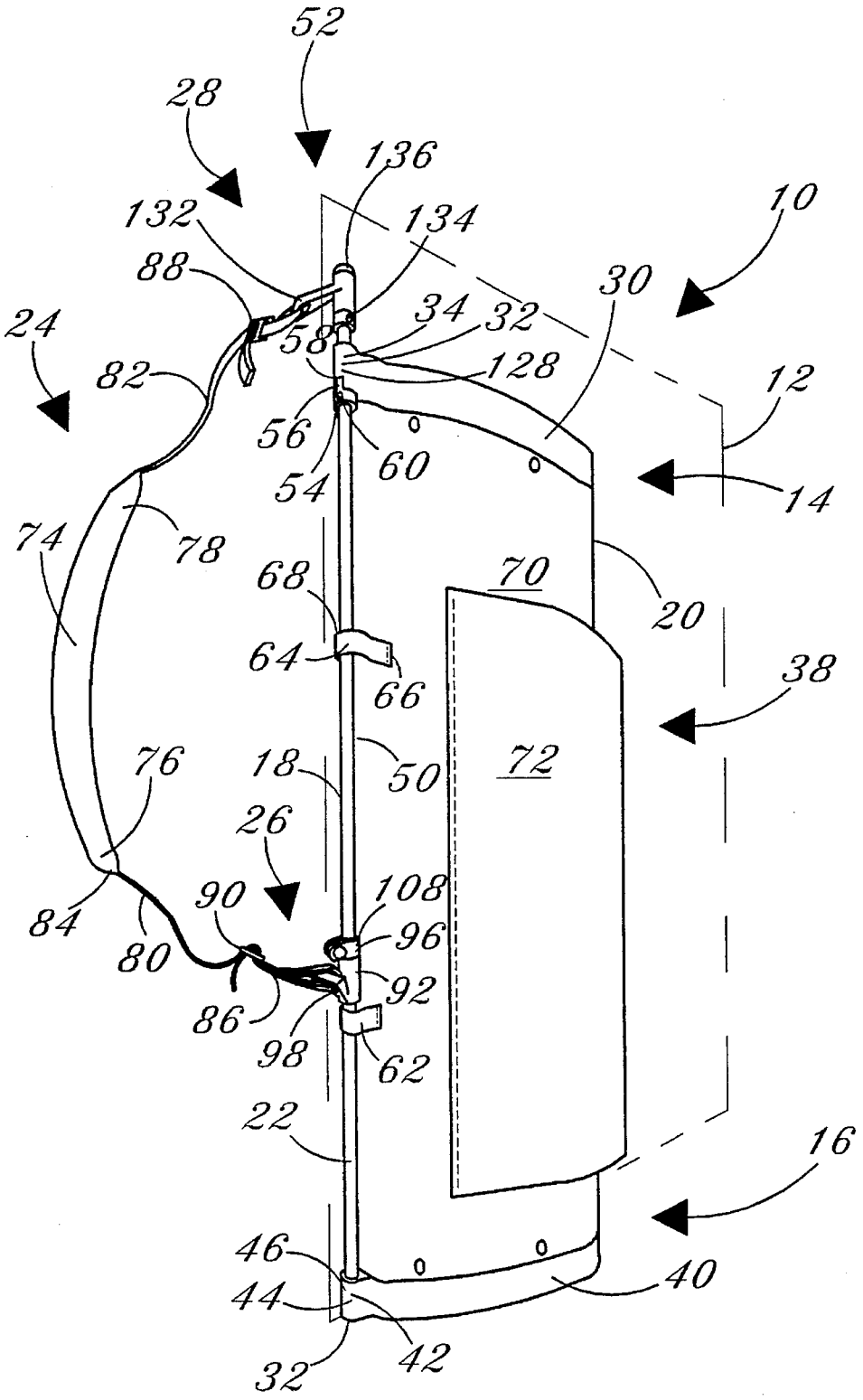
FIG. 1 is a perspective view of the preferred embodiment of the inventive, adjustable balance golf bag.

Referring now to FIG. 1, the preferred embodiment of the present invention is illustrated in a perspective view and is designated by the general reference character 10. The preferred embodiment is a golf bag 10 formed along a longitudinal plane 12 extending through the golf bag 10. The golf bag 10 has an upper end 14, a lower end 16, a spine 18, and a front side 20. An extended post 22 is attached to the bag 10 along the spine 18. In the preferred embodiment the golf bag 10 is bilaterally symmetrical about the longitudinal plane 12.

An adjustable balance in the bag 10 is achieved by a carrying strap assembly 24 that is connected to the extended post 22 by a first connector assembly 26 and a second connector assembly 28. The first connector assembly 26 can be slidably moved over a range of positions along the extended post 22 and locked into place. A wide range of balance positions is provided by altering the position of the first connector assembly 26 along the extended post 22. Both the first and second connector assemblies (26 and 28) are freely rotatable about the extended post 22, providing additional stability while carrying the bag 10.

As shown in FIG. 1 the upper end 14 of the golf bag 10 includes a collar 30. The collar 30 has an upper post retainer 32 integrally formed therefrom. The upper post retainer 32 includes an upper surrounding wall 34 and a longitudinally disposed, cylindrically shaped, upper post aperture 36. The upper post aperture 36 extends the entire length of the upper post retainer 32. In the preferred embodiment the collar 30 and integrally formed upper post retainer 32 are formed from high impact plastic.

A bag body 38 extends downward from the upper end 14 of the golf bag 10 and terminates in the golf bag base 40. The bag body 38 circumferentially extends from the collar 30 to the base 40. Similar to the collar 30, the base 40 has an integrally formed lower post retainer 42. Like the upper post retainer 32, the lower post retainer 42 has an lower surrounding wall 44, and a cylindrically shaped lower post aperture 46. The lower post aperture 46, however, does not extend the entire length of the lower post retainer 42, and terminates in a stop floor 48.

The upper and lower post apertures (36 and 46) are cylindrically shaped to receive the extended post 22. The extended post 22 has the shape of a long, straight cylinder. The extended post 22 is disposed within the longitudinal axis plane 12, adjacent and exterior to the golf bag spine 18, creating a slide gap 80 between the post 22 and the spine 18. The post 22 rests against the lower post stop floor 48 and extends from within the lower post retainer 42, through the upper post retainer 32, and above the upper end 14 of the golf bag 10, terminating in an extended post upper end 52. As shown in FIG. 1, the extended post 22 is secured to the upper post retainer 32 by a first stop ring 54 that fits into the upper post retainer 32.

Figure 2:
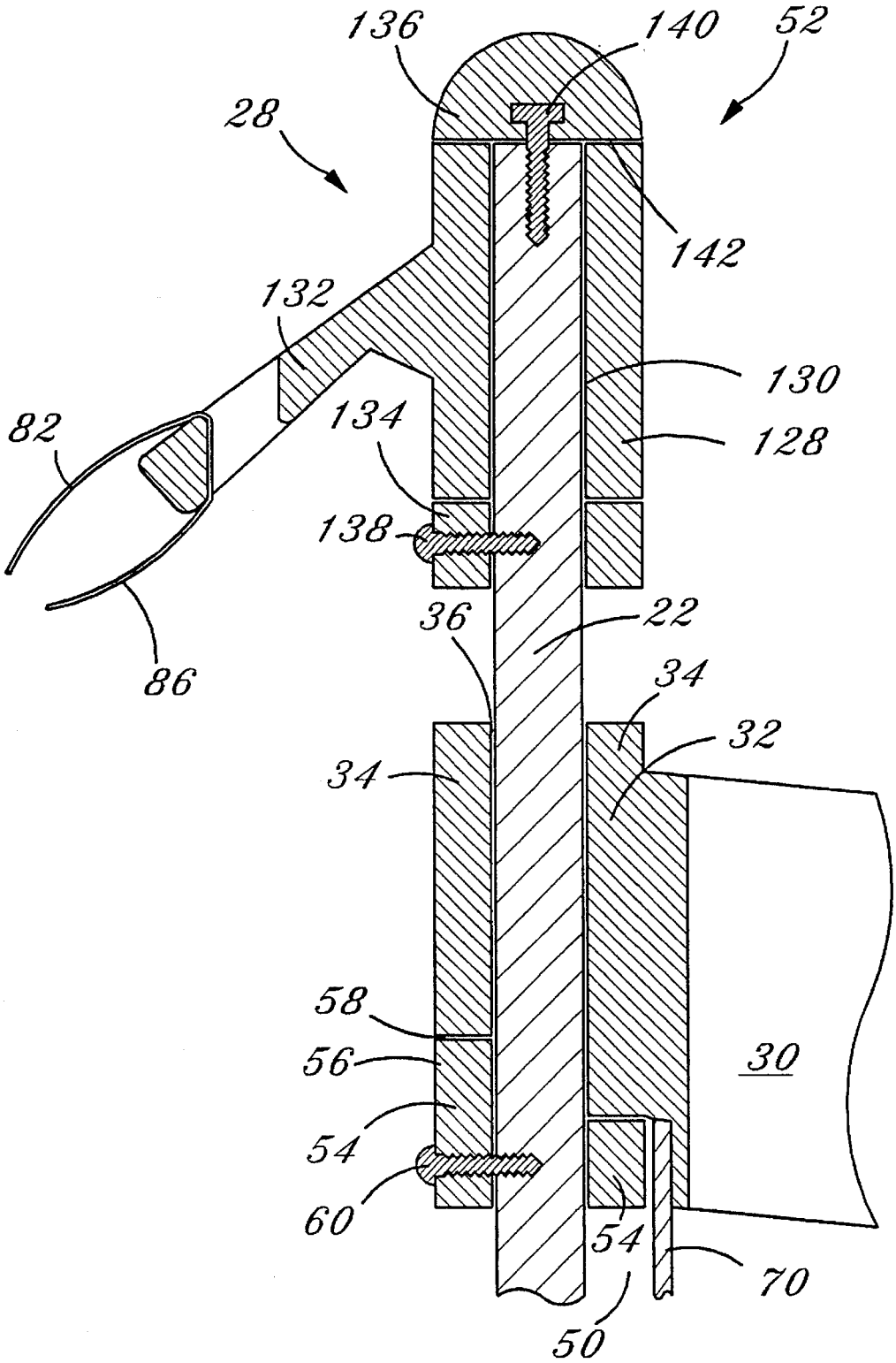
FIG. 2 is side cross sectional view of the upper post retainer and the second connector assembly.

FIG. 2 sets forth in detail the second connector assembly 28, the upper post retainer 32, and the upper portion of the extended post 22, and particularly the first stop ring 54. The first stop ring 54 has the general shape of ring with a upwardly projecting tooth 56. The first stop ring 54 surrounds the extended post 22, and is positioned so that the tooth 56 fits into a notch 58 within the upper post retainer 32. A screw 60 is driven through the first stop ring 54 into the extended post 22. This arrangement prevents the extended post 22 from sliding in a longitudinal direction, or rotating within the post apertures (36 and 46).

The extended post 22 is further secured to the bag body 38 by a first restraining strap 62 and a second restraining strap 64. Each restraining strap (62 and 64) is a rectangular piece of material having a first strap end 66 and a second strap end 68. The first restraining strap 62 is situated along the bag spine 18, about one third the distance from the base 40 to the collar 30. The first restraining strap 62 is sewn to the golf bag spine 18 at its first end 66, looped around the extended post, and sewn to the spine at its second end 68. The second restraining strap 64 is identical to the first restraining strap 62, only it is situated approximately two thirds of the distance from the base 40 to the collar 30.

One skilled in the art will immediately recognize that the extended post 22 does not have to be secured to the golf bag 10 at the collar 30 and the base 41. The extended post 22 could just as easily be attached to the spine 18 by a number of methods, including any combination of restraining straps, glues/epoxies, rivets, screws, or post retainers extending from the golf bag spine 18, provided that one or more suitable slide gaps 50 are formed between the post 22 and the golf bag spine 18.

The preferred embodiment utilizes a bag 10 of "soft-sided" design, that is, the golf bag 10 may or may not include an inner rigid frame extending from the base 40 to the collar 30, but will have deformable sides to conform somewhat to the shape of the golfer. Longitudinal rigidity, if not otherwise provided, will be maintained by the extended post 32. One skilled in the art will immediately recognize that the inventive adjustable balance design may be utilized on any type of bag, regardless of shape, size, or design. In fact, as will be explained below, the adjustable balance design makes the shape and arrangement of a golf bag less critical due to the increased adjustment options provided.

As illustrated in FIG. 1, the preferred embodiment includes a plurality of conventional golf bag pockets 72 situated on the bag body. These pockets 72 are provided for the storage and transportation of golfing paraphernalia.

FIG. 1 illustrates the adjustable carrying strap assembly 24 of the adjustable balance bag design 10. In the preferred embodiment, the carrying strap assembly 24 includes a pad portion 74 with a first pad end 76 and second pad end 78, the first carry strap 80 and second carry strap 82, and the first 26 and second connector assemblies 28. The first and second carry strap (80 and 82) each have a pad end 84 and a connector end 86. The pad end 84 of the first carry strap 80 is sewn to the first end 76 of the pad 74, and the pad end 84 of the second carry strap 82 is sewn to the second end 78 of the pad 74. The connector end 86 of the first carry strap 80 is connected to the first connector assembly 26, and the connector end 86 of the second carry strap 82 is connected to the second connector assembly 28. A first buckle 88 and a second buckle 90 are situated between the connector end 86 and the pad end 84 of the first and second carry strap (80 and 82), respectively.

Figure 5:
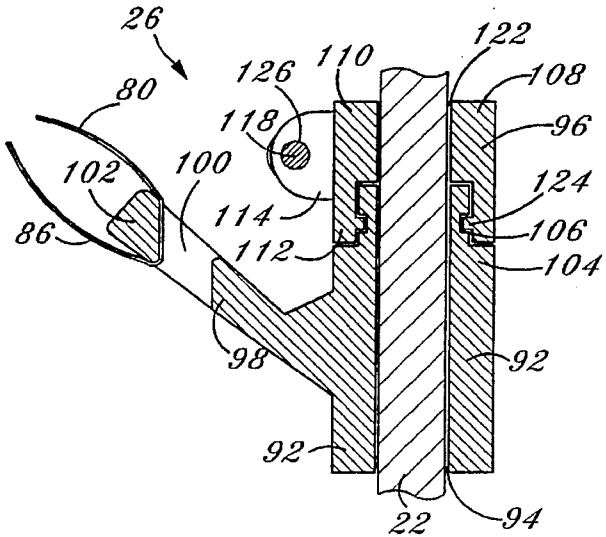
FIG. 5 is side cross sectional view of the first connector assembly taken along line 5—5 of FIG. 4.
Figure 3:
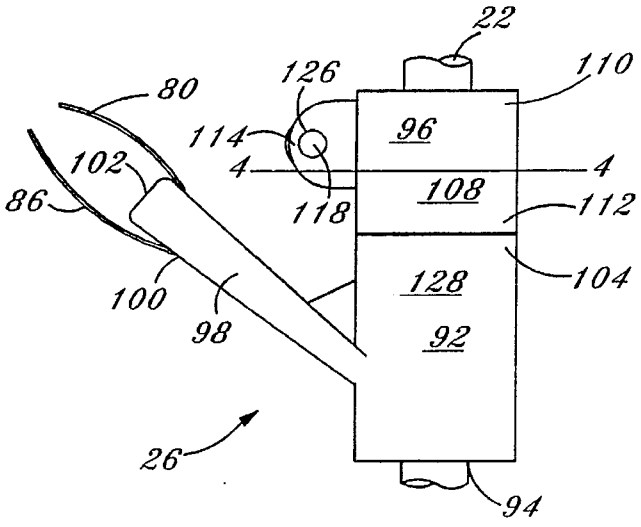
FIG. 3 is a side elevational view of the first connector assembly.
Figure 4:
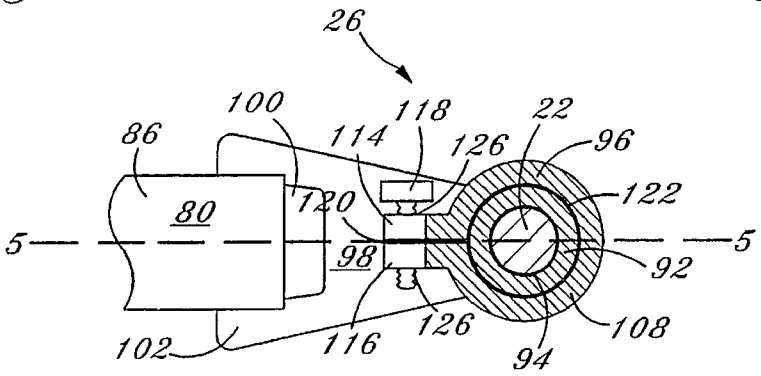
FIG. 4 is top cross sectional view of the first connector assembly end taken along line 4—4 of FIG. 3.

The first connector assembly 26 is shown in a side elevational view in FIG. 3, in a top cross sectional view in FIG. 4, and in side cross sectional view in FIG. 5. The first connector assembly 26 includes a sleeve portion 92 with a cylindrically shaped connector aperture 94, a locking mechanism 96, and a strap attachment arm 98 extending from the sleeve portion 92. The strap attachment arm 98 of the first connector assembly 80 extends from the sleeve portion 92 at an acute angle with respect to the extended post 22. As illustrated in FIG. 1, the strap attachment arm 98 of the first connector assembly 80 extends towards the upper end 14 of the bag.

The strap attachment arm 98 of the first connector assembly 26 has a strap aperture 100 and a strap attachment bar 102. The connector end 86 of the first carry strap 80 wraps around the strap attachment bar 102, through the strap aperture 100, and loops back into the first buckle 88 of the first carry strap 80. This conventional method allows the golfer to increase the length of the carry straps (80 and 82) between the connectors (26 and 28) and the pad 74. While the preferred embodiment utilizes a strap/aperture/buckle arrangement, it would be clear to one skilled in the art that any attachment method securing the strap to the connector assembly would work equally as well, such as clips, buttons, Velcro®, or buckles on the connector assemblies themselves. The strap assembly 24 itself may be varied as well. An assembly without a padded portion, or an assembly with less padding, would interconnect with the connector assemblies equally well.

As shown in FIG. 4, the sleeve portion 92 of the first connector assembly 26 has a distinct thickness, and completely surrounds the extended post 22. The first connector aperture 94 is circular in cross section, and the dimensions are such that the connector aperture diameter is larger than the post diameter, allowing the first connector 26 to slide along, and rotate about the extended post 22.

As shown in FIG. 5, the first sleeve portion 92 also has an upper sleeve end 104. The upper sleeve end 104 has a smaller thickness than the remainder of the first sleeve portion 92 and includes an annular locking groove 106.

The locking mechanism 96 of the first connector assembly 26 is best illustrated in FIGS. 3 and 4. As shown in the figures, the locking mechanism 96 includes a cinching ring having an upper ring portion 110, a lower ring portion 112, an integrally formed first eyelet 114 and an opposing integrally formed second eyelet 116, and a thumb screw 118. The cinching ring 108 has a generally annular shape, with a single longitudinal split 120. The cinching ring 108 has a variable diameter that increases or decreases as the width of the longitudinal split 120 is increased or decreased. Like the first sleeve portion 92 of the first connector assembly 26, the locking mechanism 96 surrounds the extended post 22. The cinching ring 108 also has an inner surface 122 that includes a circumferentially disposed engaging ridge 124. As shown in the figures, the cinching ring 108 overlaps the upper sleeve end 104 of the first sleeve portion 92 such that the engaging ridge 124 fits within the locking groove 106.

The eyelets (114 and 116) of the locking mechanism 96 oppose each other across the longitudinal split 120, and both include screw threads 126, aligned with each other, perpendicular to the extended post 22. The thumb screw 118 is threaded through the first eyelet 114 into the second eyelet 116. As the thumb screw 118 is tightened, the eyelets (114 and 116) draw together, decreasing the width of the longitudinal split 120, which decreases the inner diameter of the cinch ring 108 until the inner surface 122 of the cinch ring 108 engages the extended post 22. Once the cinch ring 108 engages the extended post 22, the locking mechanism 96 is in the locked position. Conversely, when the thumb screw 118 is loosened the eyelets (114 and 116) draw apart, increasing the inner diameter of the cinching ring 108, and unlocking the locking mechanism 96. Because the first sleeve portion 92 of the first connector 26 is mechanically coupled to the cinch ring 108 by the engaging ridge 124-locking groove 106 connection, when the locking mechanism 96 is in the locked position, the entire first connector assembly 26 is prevented from sliding along the extended post 22.

As shown in FIG. 4, the eyelets (114 and 116) and thumb screw 118 are located at the upper ring potion 110 of the locking mechanism 96 while the engaging ridge 124 is located at the lower ring portion 112. This configuration allows the first sleeve portion 92 to rotate about the extended post 22 even when the locking mechanism 96 is in the locked position. The engaging ridge 124-locking groove 106 arrangement, while preventing sliding motion along the extended post 22 , allows the first sleeve portion 92 of the first connector assembly 26 to rotate within the locking mechanism 96.

The sliding travel of the first connector assembly 26 along the extended post 22 is limited by the first restraining strap 62 in the lower direction, and by the second restraining strap 64 in the upper direction.

As shown in the cross section of FIG. 2, the second connector assembly 28 is situated along the extended post 22, above the bag collar 30. Like the first connector assembly 26, the second connector assembly 28 includes a second sleeve portion 128, a second connector aperture 130, and a second strap attachment arm 132. Unlike the first connector assembly 26, however, the second connector assembly 28 does not have a locking mechanism 96. The second connector assembly 28 is held in place by a second stop ring 134, and a post end stop 136. The second stop ring 134 is similar to the first stop ring 54 in that it is an annular structure that surrounds the extended post 22, and like the first stop ring 54 the second stop ring 134 is held in place by a second screw 138 extending through the second stop ring 134 into the extended post 22. Unlike the first stop ring 54, the second stop ring 134 does not have a projecting tooth 50. The post end stop 136 is a semi-spherical structure attached to the extended post upper end 52. In the preferred embodiment, the post end stop 136 includes a longitudinally disposed end screw 140 that extends into the extended post 22. The post end stop 136 has a circular flat side 142 that is larger in diameter than second connector aperture 136 of the second connector assembly 28.

As is best shown in FIG. 2, the second connector assembly 28 is situated between the flat side 142 of the post end stop 136 and the second stop ring 134. While the second connector assembly 28 is free to rotate about the extended post 22, it is prevented from longitudinal sliding motion in an upward direction by the post end stop 136, and in a downward direction by the second stop ring 134.

Figure 6:
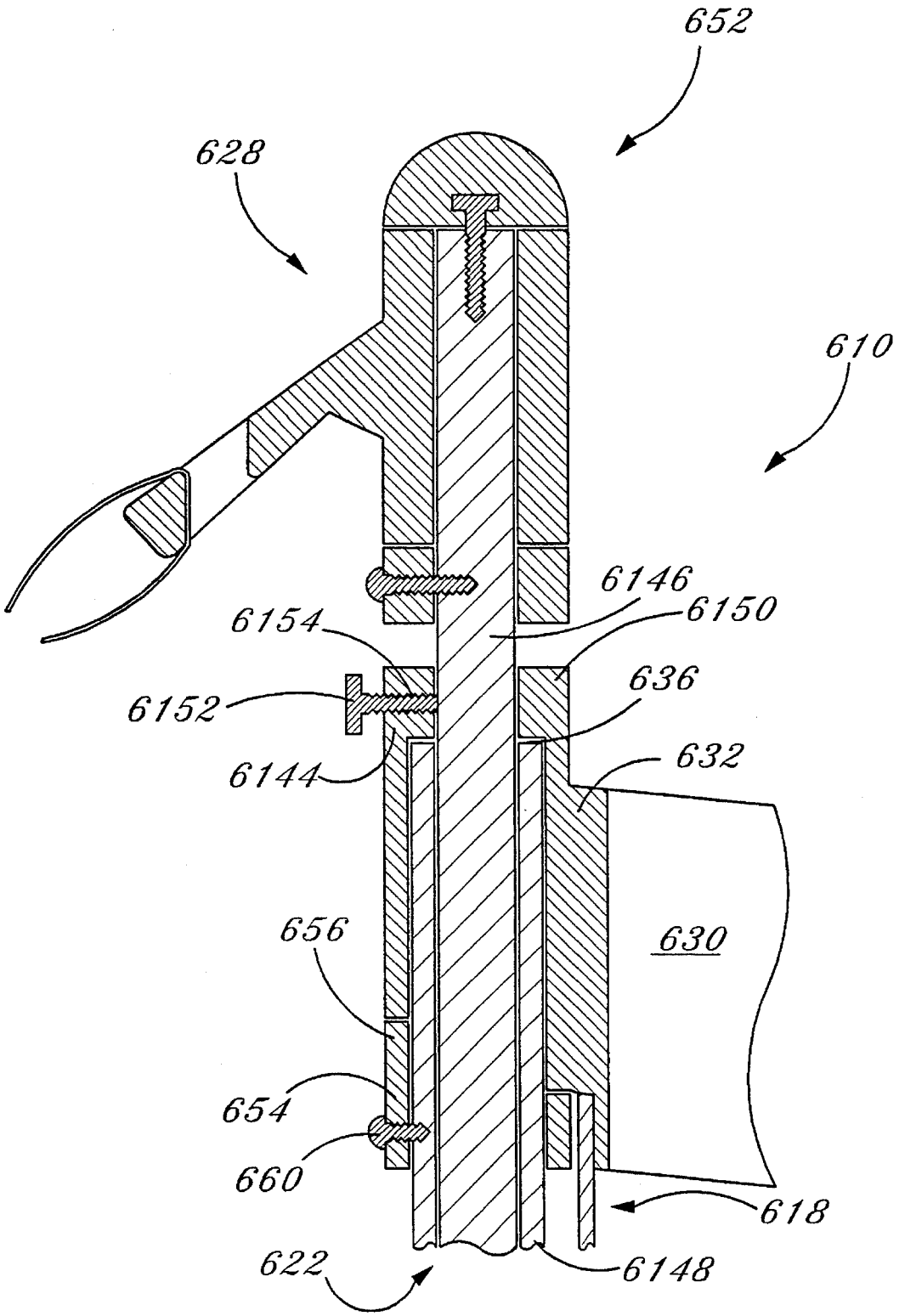
FIG. 6 is a side cross sectional view, similar to that of FIG. 2, showing an alternate extendible upper post assembly.

An alternate embodiment is illustrated in the side cross sectional view of FIG. 6. The alternative embodiment is, in many respects, similar to the preferred embodiment illustrated in the other figures. To this end, components which are identical to those appearing in the preferred embodiment will be referred to by reference numbers incorporating the original reference with an initial digit "61."

As shown in the figure the alternate embodiment 610 is similar to preferred embodiment 10 but differs in that it includes a telescoping extended post 622 and a telescope lock 6144. The extended post 622 of the alternate embodiment 610 has an inner post portion 6146 and a surrounding outer post portion 6148. The outer post portion 6148 is a long, annular structure that is positioned along the spine 618 like the extended post 22 of the preferred embodiment 10. The outer post portion 6148, unlike the extended post 22 of the preferred embodiment 10, does not extend above the upper post retainer 632, but instead abuts an overhang portion 6151 of the upper post retainer 631 of the alternate embodiment 610.

The inner post portion 6141 is a solid cylindrical structure, similar to the extended post 22 of the preferred embodiment. The inner post portion 6146 is disposed within the outer post portion 6148. The extended post 612 of the alternate embodiment 610 telescopes above the collar 630 by the inner post portion 6146 sliding upward from within the outer post portion 6148.

In the alternate embodiment, the upper post retainer has an upper post retainer notch 658. Like the extended post 22 of the preferred embodiment 10, the outer post portion 6148 is prevented from rotating within the upper post aperture 636 by a first stop ring 645 having first stop ring tooth 656 that fits within the upper post retainer notch 656. A screw 660 extends through the first stop ring 656 into the outer post portion 6148.

The telescope lock 6144 is shown in FIG. 6. As shown in the figure, the telescope lock 6144 is a clamp screw 6151 and a threaded clamp aperture 6154 within the overhang portion 6150 of the upper post retainer 632. As the clamp screw 6152 is tightened the clamp screw impacts inner post portion 6146, holding it in place. An extended post upper end 652 of the alternate embodiment is identical to the extended post upper end 52 of the preferred embodiment 20. The telescope lock 6244 allows the upper post portion 652, including a second connector assembly 628, to be extended far above the collar 630 and locked into position, for wider range of balance adjustments.

While the telescope lock 6144 of the alternate embodiment utilizes a clamp screw 6252 and threaded clamp aperture 6154, it would clear to those skilled in the art that a locking mechanism similar to the locking mechanism 96 of the preferred embodiment would work equally well as a telescope lock.

In the preferred embodiment, when the locking mechanism 96 of the first connector assembly 26 is locked, the first connector assembly 26 is prevented from sliding along the post 22. Both connector assemblies (26 and 28), however, are free to rotate in a radial direction about the extended post 22. This feature is particularly advantageous for those golfers who prefer carrying the bag under one shoulder while the strap assembly is looped over the other shoulder. One or both of the rotatable connectors rotate in the direction of the carrying shoulder, to ensure the strap does not twist or apply undue torque to the golfer's shoulder.

It would be clear to those skilled in the art that there can be a number of variations on the basic structure set forth above. For example, the connector assemblies (26 and 28) can be constructed so that the locking mechanism 96 and the sleeve portions (92 and 228) are a single, integral structure. When locked, such a connector assembly would not move in either a longitudinal direction along, or a rotational direction about, the extended post 22. The locking mechanism 96 can vary as well. Instead of a cinching ring 108, the a single thumb screw 228 can extend through the connector assembly (26 and 28) and engage the extended post 22. The post 22 itself can be altered to facilitate locking. For example, the post 22 could include a number of apertures for engaging a spring pin on the locking mechanism 96.

The extended post 22 is not necessarily restricted to a strictly cylindrical shape. The post 22 could have a cross section that is generally circular, but with a portion removed, creating a longitudinal flat surface along the length of the post. This flat surface could include ridges or the like for a ratchet type locking mechanism. The post could be rail of rectangular cross section and the connector assembly include a hinged structure for rotational movement. In addition, the cross sectional aspect of the post can be varied to provide a different limit to the connector assembly travel. For example, the cross sectional aspect of the extended post 22 can have an abrupt change from a circular to square cross section, the square cross section being greater than the size of the post aperture, and thus providing a stop to the sliding connector.

The inventive bag design is not limited to a single extended post 22 either. The design 10 could work with two separate posts disposed along the spine 18, one towards the upper end 14 of the bag 10, and one towards the lower end 16 of the bag 10, each post having a connector assembly (26 and 28).

In addition to the above mentioned examples, various other modifications and alterations of the dimensions, materials, orientation and usages may be made without departing from the invention. Accordingly, the above disclosure is not to be considered as limiting and the appended claims are to be interpreted as encompassing the entire spirit and scope of the invention.

INDUSTRIAL APPLICABILITY

The adjustable balance golf bag 10 is intended to be used by a golfer to transport a set of golf clubs. When preparing to embark on a golfing excursion, the golfer will unlock the first connector assembly 26 of the preferred embodiment and slide it along the extended post 22 into the position which create the optimal balance for the particular golfer and particular load to be carried in the bag 10. The first connector assembly 26 can then be locked into this optimal position preserving the configuration for the golfer. The rotatable connector assemblies (26 and 28) will automatically rotate about the extended post 22 for optimal balance and comfort. This adjustment is particularly suited to golfers who carry the bag 10 on one side of the body, with the carry strap 24 slung over the shoulder of the other side of the body. This rotational movement is also useful for those golfers who do not carry their bag 10 in a plane perpendicular to the shoulders.

After one golfer completes a game of golf, the adjustable balance bag 10 can be used almost immediately by a second golfer (or by a caddy), who will go through the sliding adjustment to configure the bag 10 for the second person's carrying style and load. Children, or smaller golfers in particular, will appreciate the range of balance configurations provided by the bag 10, as these golfers are frequently plagued with continuous bag tipping when using conventional bags. The simple adjustment of the first connector assembly 26 on the adjustable balance bag 10 can immediately eliminate this problem.

The adjustable balance bag 10 is also valuable to golfers traversing those golf courses offering varied terrain (or those golfer's who regularly end up traversing adverse terrain). As the golfer approaches an uphill or downhill slope he can adjust the bag 10 balance to more suit his body position has he traverses the slope. Also, in particularly uneven ground, as is the case in many out-of-fairway areas, the golfer can adjust the bag to bring it closer to the body and thus make the bag 10 more controllable.

The value of the adjustable balance bag 10 is not lost to the caddy either, who can quickly change the bag 10 from the golfer's configuration to his own, avoiding a potentially uncomfortable foray.

For the above reasons, and others, it is expected that the adjustable balance golf bag 10 of the present invention will have widespread industrial applicability. Any golfer seeking a golf bag with wide flexibility in balance configurations will appreciate the present invention. Therefore, it is expected that the commercial utility of the present invention will be quite extensive.

What is claimed is:

1. A golf bag for transporting golf clubs comprising:

a golf bag body including a longitudinally disposed surrounding wall, the wall defining a bag interior and a bag exterior, the golf clubs being transported within the bag interior, the wall having a spine portion and an opposing front portion, said bag body terminating in an upper end and a lower end;

post securing means spaced longitudinally along the spine portion, for fixedly securing at least one post in a longitudinal direction of said golf bag;

at least one post secured to said golf bag by said post securing means, extending along a substantial longitudinal extent of the spine portion;

at least one strap connector slidably and rotatably mounted about said at least one post, one of said at least one strap connector including locking means having a locked and an unlocked position, said one strap connector further being longitudinally immobilized along said at least one post but rotatable thereabout when said locking means is in the locked position; and a golf bag strap for carrying the golf bag, said strap having a first strap end and a second strap end, both strap ends being ultimately attached to the golf bag, at least one of the strap ends being attached to said one strap connector.

2. The golf bag of claim 1 further including:

a plurality of slide stops disposed on said at least one post for limiting the slidable travel of said one strap connector along said at least one post.

3. The golf bag of claim 2 wherein:

said post securing means further includes at least one retaining loop extending from the bag exterior; and said slide stops include the at least one retaining loop of said post securing means.

4. The golf bag of claim 1 further including:

said post securing means includes at least one post retainer depending from the spine of said golf bag body, each said at least one post retainer having a post retaining aperture disposed parallel to the golf bag spine for receiving said at least one post.

5. The golf bag of claim 4 wherein, for each said post securing means:

said bag body further includes a collar attached to the upper end of said golf bag body and a base attached to the at least one lower end of said golf bag body; and said post securing means includes a collar ring that is integrally formed from the collar, and a base ring that is integrally formed from the at least one base, the post retaining aperture having a circular cross section;

said at least one post has a circular post cross section that is smaller than the at least one retaining post aperture cross section, said at least one post being disposed within said at least one post retaining aperture, so as to be parallel to the spine of the golf bag body.

6. The golf bag of claim 5 wherein:

said post securing means further includes a rotation restricting means for preventing rotation of the associated at least one post.

7. The golfbag of claim 1 wherein:

the number of said at least one post is one;

said post includes an upper post portion that extends above the upper end of said golfbag body and terminates in a distal post end;

said one strap connector is an upper connector that is mounted about the upper post portion.

8. The golf bag of claim 7 wherein:

the distal post end includes a permanently attached end stop;

a stop member is affixed to the upper post portion of said post at a position displaced from the end stop; and said upper connector is disposed between the end stop and the stop member, with the end stop preventing longitudinal movement in an upward direction, the stop member preventing longitudinal movement in the downward direction.

9. The golf bag of claim 1 wherein:

each said at least one post is circular in cross section, having a post diameter; and each said at least one strap connector includes a sleeve portion having a cylindrical aperture with a larger diameter than the post diameter, said at least one post being disposed within said cylindrical aperture.

10. The golf bag of claim 9 wherein:

said locking means of said one strap connector is a friction ring, the friction ring having an inner friction ring diameter that may be adjustably tightened to frictionally contact the at least one post and thereby restrict the movement of said one strap connector.

11. The golf bag of claim 1 wherein:

said one strap connector includes a lock portion and a strap engaging portion for attaching a strap, the lock portion including the locking means, the strap engaging portion being rotatable about said at least one post and rotatably coupled to the lock portion such that when the locking means is in the locked position the strap engaging portion is free to rotate about the at least one post but is immobile in the longitudinal direction;

one said strap end is attached to the strap connector at the strap engaging portion.

12. In a golf bag having a club receiving body portion and a carrying strap, the body portion having a bag length, a top, a bottom, and a spine portion, the carrying strap including first and second ends for attaching the carrying strap to the spine portion of the golf bag, the improvement comprising:

an extended post secured to the golf bag and disposed parallel to and slightly displaced from the spine portion, and extending along a substantial longitudinal extent thereof, said extended post having a top end extending beyond the top of the golf bag;

an upper connector assembly, rotatable about said extended post during usage, for attaching the first end of the connector strap to said extended post at a portion near the top end; and a lower connector assembly for attaching the second end of the carrying strap to said extended post at a range of positions substantially displaced from the top end, said lower connector assembly including releasable securing means for affixing to a position within the range of positions.

13. The improvement of claim 12 wherein said lower connector assembly is rotatable about said extended post.

* * * * *